United States Patent [19]

Kato et al.

[11] Patent Number: 4,569,104

[45] Date of Patent: Feb. 11, 1986

[54] APRON FOR A DRAFT APPARATUS

[75] Inventors: Hisaaki Kato, Shiga; Shoji Sakai, Nagaokakyo, both of Japan

[73] Assignee: Murata Kikai Kabushiki Kaisha, Japan

[21] Appl. No.: 578,022

[22] Filed: Feb. 8, 1984

[30] Foreign Application Priority Data

Feb. 14, 1983 [JP] Japan ..... 58-22530

[51] Int. Cl.[4] ..... D01H 5/86

[52] U.S. Cl. ..... 19/244; 19/248; 19/153; 474/252; 474/263

[58] Field of Search ..... 19/244, 153, 248, 249, 19/250, 236; 474/262, 263, 264, 252; 428/114, 295

[56] References Cited

U.S. PATENT DOCUMENTS

| | | | |
|---|---|---|---|
| 1,592,416 | 7/1926 | Brownell | 474/252 |
| 2,402,356 | 6/1946 | Bacon et al. | 19/244 |
| 4,127,039 | 11/1978 | Hollaway | 474/263 |

*Primary Examiner*—Louis K. Rimrodt
*Assistant Examiner*—J. L. K. Olds
*Attorney, Agent, or Firm*—Spensley Horn Jubas & Lubitz

[57] ABSTRACT

An apron for a draft apparatus being suitable for use with a pneumatic high speed spinning frame. The apron includes a front side rubber layer, a reverse side rubber layer adhered to the front side rubber layer and core cords interposed between the two rubber layers. The peripheral borders of the apron have such a construction that one of said rubber layers is retracted from the other of the rubber layers.

9 Claims, 21 Drawing Figures

FIG. 2
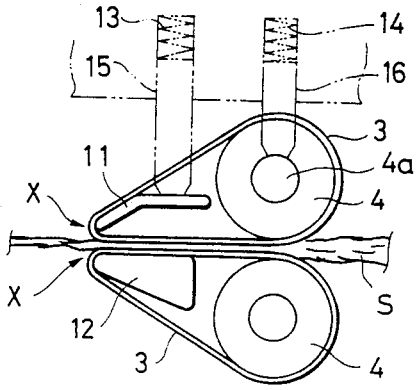
FIG. 3-a
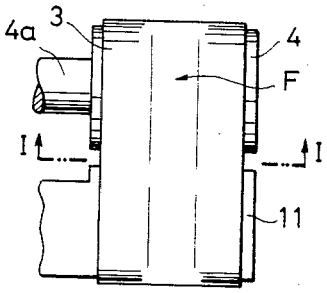
FIG. 3-b
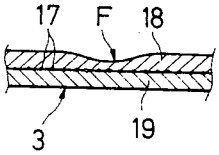
FIG. 4-a
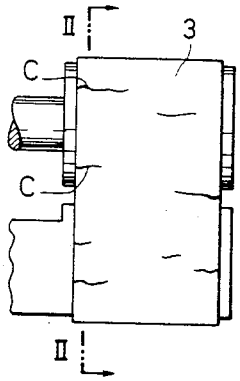
FIG. 4-b
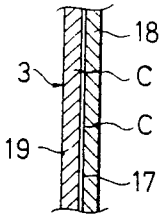

FIG. 5
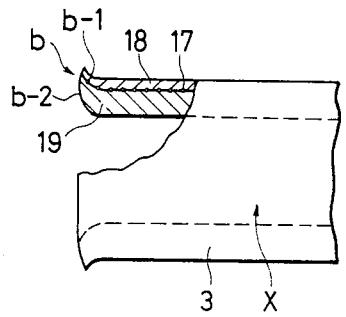
FIG. 6-a
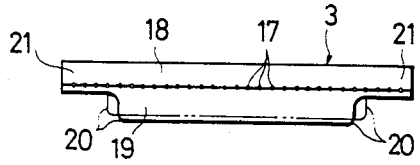
FIG. 6-b
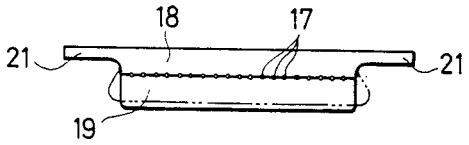
FIG. 6-c
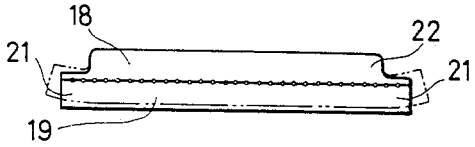
FIG. 6-d
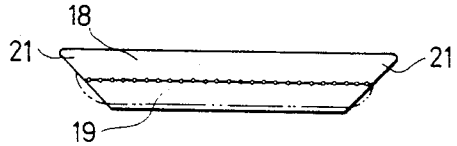
FIG. 6-e
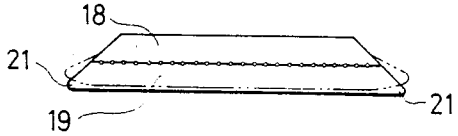
FIG. 6-f
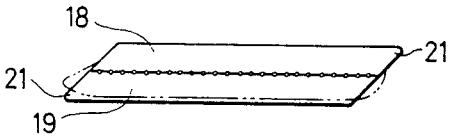

FIG. 7-a
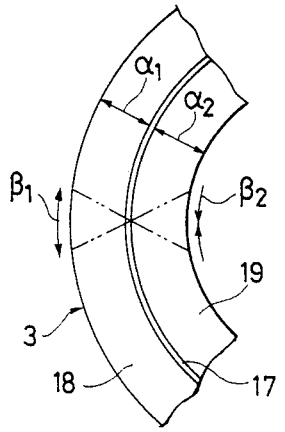
FIG. 7-b
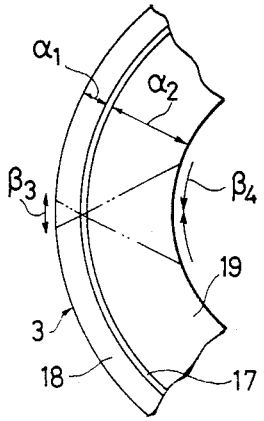
FIG. 8
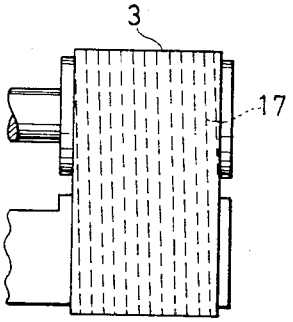
FIG. 9
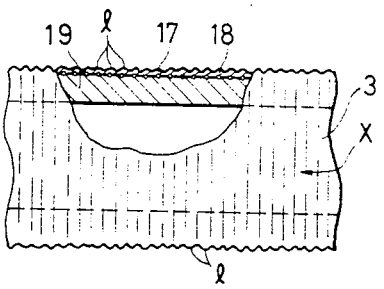

APRON FOR A DRAFT APPARATUS

BACKGROUND OF THE INVENTION

1. Field of the Invention:

This invention relates to an apron for a draft apparatus which is suitable for use with a spinning machine, especially with a pneumatic high speed spinning frame and further to a method of producing the same.

2. Prior Art:

A draft apparatus is already known in the art in which, in order to draft slivers, such slivers are passed sequentially between a plurality of pairs of pressure contacted rollers, which are arranged such that they have gradually increasing circumferential speeds in the order as slivers advance. In such known draft apparatus, it is one of particularly serious problems how draft irregularities are reduced which have a worst effect on qualities of yarns, such as uniformity, strength, and so on.

In a draft apparatus of a three line type, such rollers as described above include back, middle and front roller pairs, and a belt commonly called an apron is mounted on each of rollers of the middle roller pair. One of causes of such irregularities as mentioned above is deformation of an apron due to wear. Particularly when compared with a spinning frame such as of the ring type in which a draft rate is low, a pneumatic spinning frame operates at a high speed and directly drafts slivers. Consequently, in a pneumatic spinning frame, the draft rate is very high and middle rollers are rotated also at a high speed, resulting in rapid progress of deformation of the middle rollers by wear.

SUMMARY OF THE INVENTION

An object of the present invention is to provide an apron which can eliminate deformation by wear and cracks and a method of producing the same.

According to the present invention, each of opposite peripheral borders of an apron has a construction that one of the front and reverse side rubber layers of the apron recedes from the other of the two.

BRIEF DESCRIPTION OF THE DRAWINGS

FIG. 2 is a side elevational view showing middle rollers of the penumatic spinning frame;

FIG. 3-*a* is a plan view of an apron which has a low wear resistance, illustrating deformation of the apron due to wear and FIG. 3-*b* is a sectional view taken along line I—I of FIG. 3-*a;*

FIG. 4-*a* is a plan view of an apron which has a high wear resistance, illustrating cracks appearing on the apron and FIG. 4-*b* is a sectional view taken along line II—II of FIG. 4-*a;*

FIG. 5 is a front elevational view showing a peripheral border of an apron around a bending location;

FIGS. 6-*a* to 6-*f* are sectional views illustrating constructions of various aprons in accordance with the present invention;

FIGS. 7-*a* and 7-*b* are side elevational sectional views showing bent portions of aprons which have different ratios of thickness between rubber layers thereof;

FIG. 8 is a plan view of an apron illustrating core cords thereof;

FIG. 9 is a front elevational view of a bent portion of an apron in which a front side rubber layer is relatively thin;

DETAILED DESCRIPTION OF THE INVENTION

Figure 1:
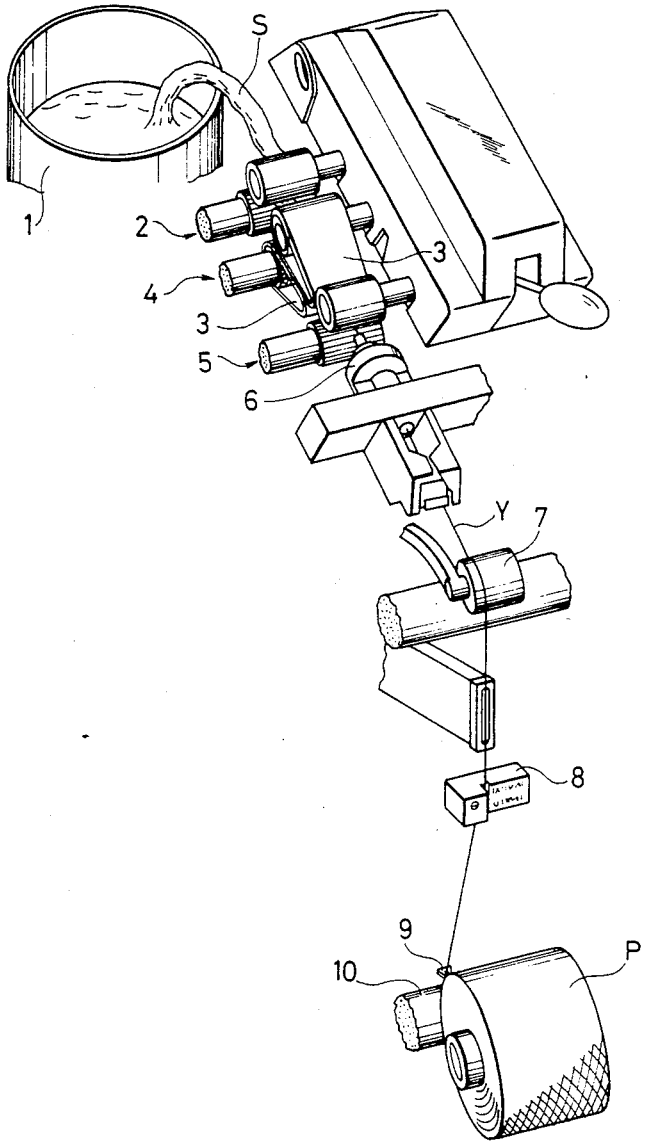
FIG. 1 is a perspective view showing a general construction of a pneumatic spinning frame.

The deformation of an apron due to wear will be described more particularly with reference to FIGS. 1 to 3: FIG. 1 illustrates details of a construction of a pneumatic spinning frame; FIG. 2 illustrates middle rollers of the pneumatic spinning frame of FIG. 1; FIG. 3 shows an apron which has been deformed by wear. Referring to FIG. 1, slivers S drawn out from a sliver can 1 are passed in order between and drafted by a pair of back rollers 2, a pair of middle rollers 4 each having an apron 3, and front rollers 5. The rollers 2, 4 and 5 in each pair are rotated in mutually contacted conditions under pressure. The slivers S are then twisted into a spinning yarn Y by means of an air jet nozzle 6. The spinning yarn Y is thereafter drawn out by a delivery roller 7, passes a yarn clearer 8, a traverse guide 9 and a friction roller 10, and is wound onto a package P. Referring now to FIG. 2, a tensile force is applied to each of the aprons 3 by means of a cradle 11 or a tenser bar 12. Pins 15 and 16 are urged into engagement with the cradle 11 and a shaft 4*a* respectively for the upper one of the middle rollers 4 by means of springs 13 and 14, respectively, thereby to furnish the aprons 3 with a force to press slivers S therebetween.

In each of the aprons 3 as described just above, deformation F due to wear will appear on a portion thereof along a path of slivers S as seen in FIG. 3. Since such an apron 3 normally includes two rubber layers 18 and 19 adhered to each other and core cords 17 interposed between the rubber layers 18 and 19, such deformation appears on a front side of the front side rubber layer 18. Due to such deformation, a desired pressure cannot be maintained between both aprons 3.

It has been a common practice to improve the wear resistance of a front side rubber layer 18 in order to prevent deformation thereof due to wear. But this is naturally followed by an increase of hardness of the rubber layer 18, and cracks C might appear to the rubber layer 18 as shown in FIG. 4. Such cracks C would be caused due to the fact that the apron 3 is bent in some acute angle as at a location X of FIG. 2, and most of such cracks C appear at end portions of the apron 3 and remain in the front rubber layer 18, also constituting one of causes of draft irregularities. Further, such a trouble is also caused frequently that fibers are caught by such a crack C and thus entwined with the apron 3.

Thus, with such circumstances taken into consideration, the present invention has been made successfully after considerable efforts, and according to the present invention, an apron which can eliminate deformation by wear and cracks and a method of producing the same are provided.

After detailed observations of such aprons 3 as described above, the inventor acknowledged that a conventional apron 3 has swollen portions b notably formed on peripheral borders or edges thereof around the aforementioned bending location X, as shown in FIG. 5. The swollen portion b includes a front swollen portion *b*-1 in the front side rubber layer 18 and a reverse swollen portion *b*-2 in the reverse side rubber layer 19 and are formed such that, where the apron 3 is bent, a circumferential compressive stress acts upon the reverse side rubber layer 19 and causes it to be swollen in a widthwise direction to thus form the reverse side swollen portion *b*-2 which then pushes up a peripheral border portion of the front side rubber layer 18 thereby to form the front side swollen portion *b*-1 in the form of an angle. At this instant, the front side rubber layer 18 is acted upon over the entire bending location X by a tensile stress in a circumferential direction of the apron 3. This tensile stress acts particularly strongly upon and breaks the front side swollen portion *b*-1 thereby to cause a crack C to appear thereat.

Thus, an apron according to the present invention can be obtained by constructing the same as shown in FIGS. 6-*a* to 6-*f*.

FIG. 6-*a* shows an apron in which a reverse side rubber layer 19 has opposite peripheral borders partially recessed or removed to form shoulders 20 and in which core cords 17 are also contained in peripheral border portions 21 of the apron 3 outside the shoulders 20 of the reverse side rubber layer 19. If the reverse side rubber layer 19 of the apron 3 is swollen in a widthwise direction, then it will be deformed as shown in phantom in FIG. 6-*a*. But since the reverse side rubber layer 19 is considerably recessed along opposite peripheral borders thereof, such deformation of the reverse side rubber layer 19 does not have an effect on the peripheral border portions 21 and hence no angular swollen portion b as described above will appear on the front side rubber layer 18. FIG. 6-*b* shows another example in which recesses are formed to extend from the reverse side rubber layer 19 to some depth of the reverse side of the front side rubber layer 19 so that no core cord 17 exists in the thus formed peripheral border portions 21. Since in this case the peripheral border portions 21 are formed only by the front side rubber layer 18, they are hardly affected by swelling deformation of the reverse side rubber layer 19. FIG. 6-*c* shows a further example in which recesses are formed along opposite peripheral borders of the front side rubber layer 18. In this case, even if the opposite peripheral borders of the reverse rubber layer 19 are swollen outwardly, front side end portions or shoulder portions 22 of the front side rubber layer 18 will be hardly deformed since there is no portion of the front side rubber layer 18 on such swollen portions of the reverse side rubber layer 18. FIG. 6-*d* shows a still another example in which opposite peripheral borders of the apron 3 are cut out or removed obliquely so that the front side rubber layer 18 has a greater width than the reverse side rubber layer 19. Also in the case of this apron 3, an influence of swelling deformation of the reverse side rubber layer 19 does not reach peripheral borders of the front side rubber layer 18. FIG. 6-*e* shows yet another example in which the reverse side rubber layer 19 has a greater width than the front side rubber layer 18, contrary to the example of FIG. 6-*d*. Also in this example, peripheral borders of the front side rubber layer 18 are not subject to deformation, similarly to the example of FIG. 6-*c*. FIG. 6-*f* shows a still further example in which opposite peripheral borders of the apron 3 are recessed or removed obliquely at opposite upper and lower sides of the apron 3. Substantially similar effects can also be expected in this example.

In summary, it is sufficient that each of opposite peripheral borders of an apron has a construction that one of the front and reverse side rubber layers 18 and 19 recedes from the other of the two. By this construction, an effect that swelling deformation of the reverse side rubber layer 19 has on peripheral borders of the front side rubber layer 19 can be minimized.

Further, in order to control swelling deformation of the reverse side rubber layer 19, it is desirable to employ for the rubber layer 19 a material which has a Poisson's ratio as low as possible. To this end, it is effective to reduce a degree of freedom of the rubber layer 19 by dispersedly mixing short fibers such as, for example, polyester filaments or the like into the rubber layer 19.

In order to further control occurrence of cracks C, it is desirable to set a ratio of thickness of the front side rubber layer 18 to the reverse side rubber layer 19 to 3:7 to 1:9, as described below with reference to FIG. 7-*a*. In contrast, in the conventional apron 3, a ratio $\alpha 1:\alpha 2$ of thickness between the front side rubber layer 18 and the reverse side rubber layer 19 is designed to be almost 5:5 as seen in FIG. 7-*a*, and accordingly, the bending stress $\beta 1$ acting in the direction to extend the surface of the front side rubber layer 18 around the bending location X is substantially equal in value to another bending stress $\beta 2$ acting in the direction to compress the surface of the reverse side rubber layer 19. Thus, where the front side rubber layer 18 is made of a material which has a high wear resistance, it will be damaged by such a great bending stress $\beta 1$ in the extending direction and will have cracks C caused thereby. Here, most of the core cords 17 are actually made of cotton yarns, and the core cords 17 are spirally wound around a periphery of the apron 3 as shown in FIG. 8 and thus have a low percentage of elongation against a tensile force so that the core cords 17 act as a neutral plane relative to the two stresses $\beta 1$ and $\beta 2$. FIG. 7-*b* shows an apron according to the present invention in which the ratio $\alpha 1:\alpha 2$ of thickness between the front and reverse side rubber layers 18 and 19 is set between 3:7 to 1:9. In this case, it is meant that the core cords 17 acting as a neutral plane are displaced towards the front side of the apron 3 when compared with the case of FIG. 7-*a*. As a result, bending stresses $\beta 3$ and $\beta 4$ acting upon opposite surfaces of both rubber layers 18 and 19 change as shown in FIG. 7-*b*, and thus the bending stress $\beta 3$ on the surface of the front side rubber layer 18 is considerably small when compared with the case of FIG. 7-*a*. Accordingly, the front side rubber layer 18 is prevented from suffering from occurrence of cracks C irrespective of its material, allowing stabilized drafting without draft irregularities. Normally, a material containing NBR as a main component therein is employed for each of the rubber layers 18 and 19, and particularly a material containing a high percentage of nitrile therein is employed for the front side rubber layer 18 in order to improve the wear resistance of the same. Thus, after various experiments with an apron 3 in which such common materials are used and which has such constructions as shown in FIG. 6, it has been found that the frequency of occurrence of cracks C decreases as the ratio of thickness of the front side rubber layer 18 to the thickness of the reverse side rubber layer 19, that is, the thickness ratio $\alpha 1:\alpha 2$, decreases, and particularly below a border of the ratio of thickness $\alpha 1:\alpha 2$ provided 3:7, results which allow actual use can be obtained. At the same time, it was also acknowledged that the ratio $\alpha 1:\alpha 2$ of thickness of the front side rubber layer 18 to the reverse side rubber layer 19 below 1:9 would cause another problem as will be described below. In particular, where the rate $\alpha 1$ of thickness is too low, the core cords 17 are located adjacent the surface of the apron 3 and hence the strength of the front side rubber layer 18 is reduced, making the rubber layer 18 ready to break and making production of the rubber layer 18 difficult. And further, as shown in FIG. 9, only portions of the surface of the front side rubber layer 19 in which core cords 17 exist project like stripes therefrom so that the front side rubber layer 18 is curved in the form of fine corrugations. As a result, a bending stress in the extending direction due to such fine corrugations is caused to appear in the stripe-like portions l and cooperates with the bending stresses $\beta 1$ and $\beta 3$ in the extending direction as described above with reference to FIG. 7 to destroy the front side rubber layer 18 to cause cracks C. Such cracks C by this cause are almost eliminated by increasing the rate $\alpha 1$ of thickness of the front side rubber layer 18 higher than 1.

Figure 10:
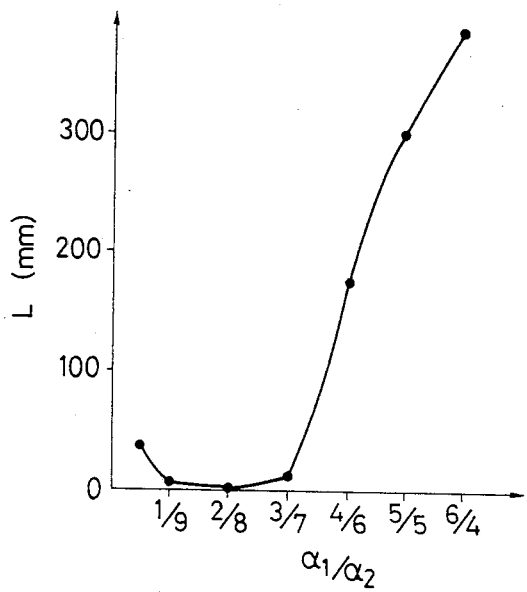
FIG. 10 is a diagram illustrating a relationship between a ratio of thickness between rubber layers and conditions of occurrence of cracks.

Although it is difficult to quantitatively show conditions of occurrence of cracks C, they are quantified by a following method, and an example of an experiment regarding a relationship thereof to the ratio of thickness is illustrated in a diagram of FIG. 10. The results were obtained with a sample apron 3 which is a quite conventional one including a front side rubber layer 18 having Shore hardness of 78.0 which is an inner diameter of 37 mm and a width of 32 mm, and which is continuously run at a surface speed of 6 m/min for a period of 500 hours. In FIG. 10, the total crack length is designated by L and is a sum total of measurements of length of all of the individual cracks C and notably indicates that it assumes the lowest value within a range of the ratio of thickness $\alpha 1/\alpha 2$ between 1/9 and 3/7. In this experiment, when the ratio of thickness $\alpha 1/\alpha 2$ was higher than 4/6, large cracks C appeared at end and central portions of the apron 3, but when the ratio was between 3/7 and 1/9, a minimum number of cracks C of minimum length appeared at end portions of the apron, and when the ratio was below 1/9, a relatively large number of cracks C of minimum length appeared over the entire apron.

It is to be noted that, in order to reduce the stripe-like portions l to smooth the surface of the front side rubber layer 18 and in order to strengthen the action of the core cords 17 as a neutral plane, it is desirable that a yarn used for the core cords 17 is fine and strong and is wound closely.

Now, a method of producing an apron according to the present invention will be described.

Figure 11:
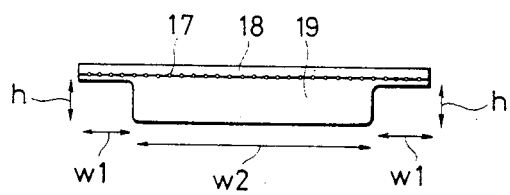
FIG. 11 is a sectional view of an apron which is produced by a production method according to the present invention.

An apron according to the present invention can be produced by removing a material of peripheral borders of a conventional apron into a predetermined configuration using a grinder or the like, but because this is time consuming and uneconomical, a method as described below is used. It is to be mentioned, however, that, since, of the aprons 3 as shown in FIGS. 6-*a*to 6-*f*, those of FIGS. 6-*b*, 6-*d*, 6-*e* and 6-*f* have no core cords 17 contained in their peripheral border portions 21, there remains a question of the strength of such peripheral border portions 21, and after it has been also taken into consideration that the ratio of thickness between the front side rubber layer 18 and the reverse side rubber layer 19 should be set within a range from 3:7 to 1:9, it is now decided to describe production of an apron 3 as shown in FIG. 11 in which the ratio of thickness is 2:8 or so.

Figure 12:
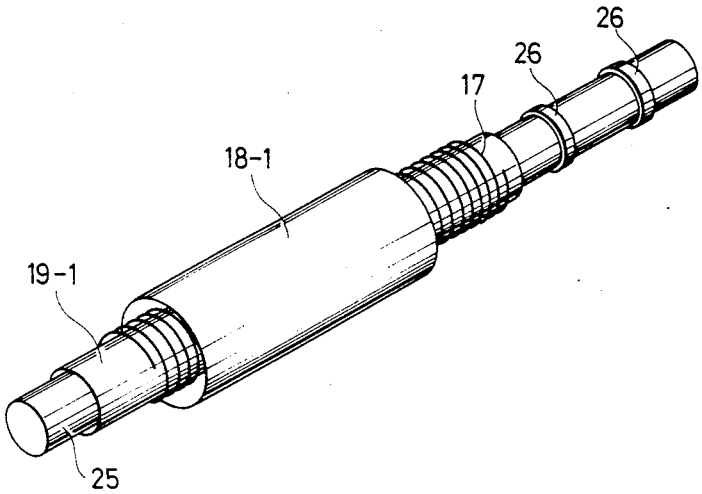
FIGS. 12 and 13 are diagrammatic representations illustrating the production method of the invention.
Figure 13:
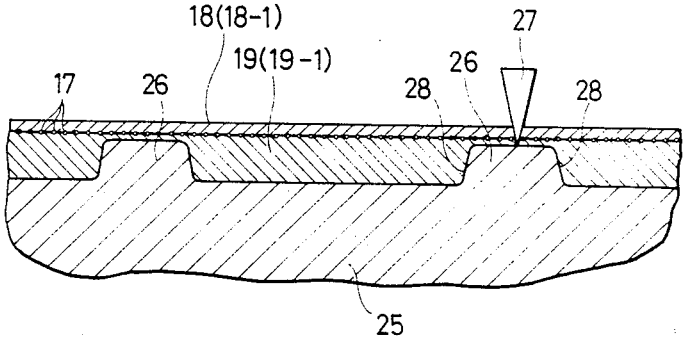

Referring to FIG. 12, a cylindrical rod 25 has a plurality of annular ribs or projections 26 formed around an outer periphery thereof in a spaced relationship from each other by distance which is equal to the width w2 of the bottom of the apron 3. Each annular projection 26 has a height equal to the height of the recesses of a desired apron 3 as shown in FIG. 11 and a width twice of the width w1 of the recesses. Thus, at first a first rubber member 19-1 making a material of a reverse side rubber layer 19 is fitted on the rod 25 and a yarn which will be made into core cords 17 is wound thereon. Then, a second rubber member 18-1 making a material of a front side rubber layer 18 is fitted on the yarn on the rod 25. The rubber members 18-1 and 19-1 are suitably designed to have such thickness that the ratio of thickness $\alpha 1:\alpha 2$ of the front and reverse rubber layers 18 and 19 of the apron 3 after shaping may be within a range from 3:7 to 1:9. Adherent is applied to a surface of the wound yarn and/or a surface of the first rubber member 18-1. Then, the assembly is heat treated by vulcanization to integrally adhere the first and second rubber members 18-1 and 19-1 to each other and to have the first and second rubber members 18-1 and 19-1 tightly fitted around the outer periphery of the rod 25 thereby to form a member in the form of a tube having a smooth surface. Here, the first rubber member 19-1 has a construction in which it is thinner around the annular projections 26 than around the remaining portion of the rod 25. Then, a sharp cutter 27 is operated against portions of the tube-formed member around the annular projections 26 from outside to divide the tube-formed member into a plurality of aprons 3, and each such apron 3 is drawn out from the rod 25. If opposite sides 28 of each annular projection 26 are formed as faces which are so inclined to decrease the width of the projection upwards, a drawing operation as described above can be performed with ease.

It is natural that, if the annular projection 26 has otherwise a cross section of a triangular shape, an apron 3 which has a construction as shown in FIG. 6-*d* can be obtained. It is also possible that the core cords 17 be made of a cloth, a leather, and so on.

As apparent from the foregoing description, according to the present invention, appearance of irregular or nonuniform distribution of stress over a surface of an apron due to bending of the apron during drafting operations can be effectively prevented. Accordingly, even if a material having a high wear resistance is used for a front side rubber layer, there will appear no cracks or the like on the apron, thereby assuring stabilized spinning without damage to the apron and without draft irregularities. Further, if a method according to the invention is employed in production of such an apron, there is no necessity of performing troublesome grinding operations of the apron, and thus the apron can be obtained easily.

We claim:

1. An apron for a draft apparatus which includes a front side rubber layer having a high abrasion resistance, a reverse side rubber layer adhered to said front side rubber layer, and core chords interposed between said front and reverse side rubber layers, said front and reverse side rubber layers defining peripheral borders extending along the length of the apron, and wherein portions of the peripheral borders of the front side rubber layer, the reverse side rubber layer, or both, are cut back such that deformation of the front side rubber layer of the apron is substantially precluded.

2. An apron as claimed in claim 1, wherein said reverse side rubber layer has opposite peripheral borders partially recessed from said front side rubber layer to form shoulders.

3. An apron as claimed in claim 1, wherein both said rubber layers are partially recessed thereby forming peripheral shoulders that extend from the reverse side rubber layers.

4. An apron as claimed in claim 1, wherein said front side rubber layer has opposite peripheral borders partially recessed thereby forming peripheral shoulders.

5. An apron as claimed in claim 1, wherein opposite peripheral borders of said apron are cut out obliquely so that the front side rubber layer has a greater width than the reverse side rubber layer.

6. An apron as claimed in claim 1, wherein opposite peripheral borders of said apron are cut out obliquely so that the reverse side rubber layer has a greater width than the front side rubber layer.

7. An apron as claimed in claim 1, wherein opposite peripheral borders of said apron are cut out obliquely so that the cut out faces are formed in a parallel relation.

8. An apron as claimed in claim 1, wherein short fibers are mixed into the reverse side rubber layer to reduce a degree of freedom of the reverse side rubber layer.

9. An apron as claimed in claim 8, wherein the ratio of thickness of the front side rubber layer to the reverse side rubber layer is between 3:7 to 1:9.

* * * * *